United States Patent [19]

Wood

[11] Patent Number: 4,664,041

[45] Date of Patent: May 12, 1987

[54] BEACH LOCKER

[76] Inventor: Gary J. Wood, 13929 Hawick Dr., El Cajon, Calif. 92021

[21] Appl. No.: 180,610

[22] Filed: Aug. 25, 1980

[51] Int. Cl.[4] ..... E05G 1/02

[52] U.S. Cl. ..... 109/51

[58] Field of Search ..... 109/50, 51, 52; 135/15 PE

[56] References Cited

U.S. PATENT DOCUMENTS

| | | | |
|---|---|---|---|
| 1,222,739 | 4/1917 | Chime | 109/50 |
| 1,571,295 | 2/1926 | Newman | 135/15 PE |
| 1,607,361 | 11/1926 | Poland | 109/51 |
| 1,959,291 | 5/1934 | Millice | 109/51 |
| 3,710,736 | 1/1973 | Biondi | 109/50 |

*Primary Examiner*—Reinaldo P. Machado
*Attorney, Agent, or Firm*—Charmasson & Holz

[57] ABSTRACT

A security lock box for use primarily at beaches having a vertical shaft terminating at its lower end with a screw and an upper end which releasibly engages a crank which can be utilized to turn the shaft and by virtue of the screw engage the shaft into the ground, subsequent to which the crank is released from the shaft, the shaft tip inserted through a hole in the lock box, a keeper is inserted on the shaft to retain the lock box, and the lock box is locked, securing within the tip of the shaft so that it may not be rotated and any valuables which have been put into the box.

2 Claims, 11 Drawing Figures

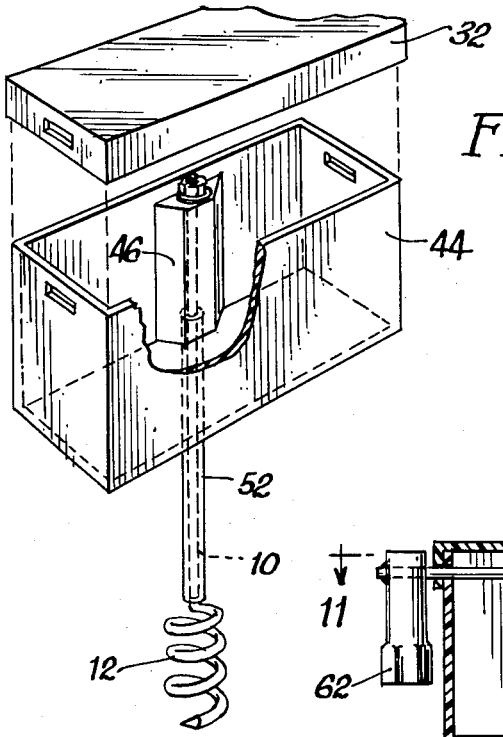
FIG. 8
FIG. 9
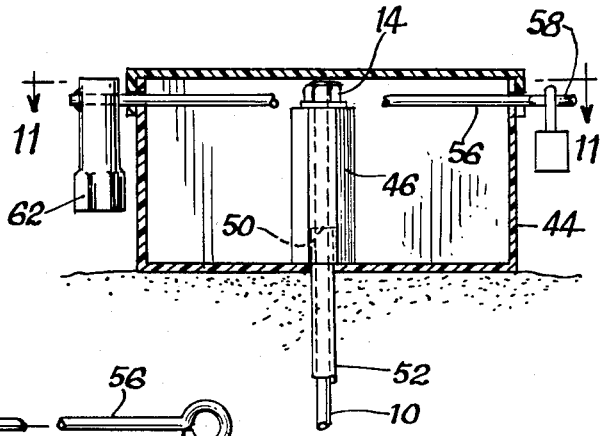
FIG. 10
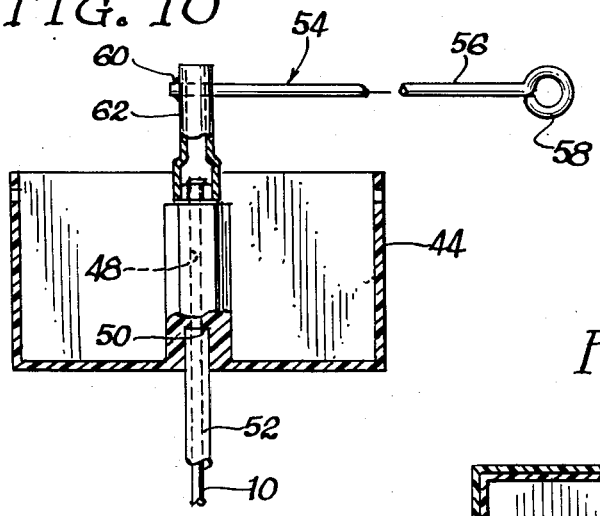
FIG. 11
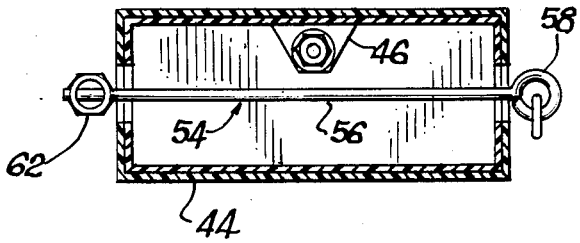

BEACH LOCKER

BACKGROUND

Anyone who frequents the beach is aware of the problem of theft of valuables left on a towel while the owner is swimming. Beach and sand areas are rather rare, if not unique, in the situation that they present wherein people on the beach during the normal course of beach enjoyment must leave valuables such as keys and some spending money unattended while they engage in normal beach activities, and there is no place provided for safekeeping of the valuables. No other activity readily comes to mind which poses these problems. Ordinarily, even when playing sports, valuables may be kept in pockets, and generally there is a locker available somewhere. On the beach however, one must divest one's self of all valuables and all clothing but a skimpy suit and then separate one's self from the valuables by going swimming, and of course beaches do not have lockers.

Probably a problem by far worse than actual theft on the beach is the anxiety produced by those prone to worry about such things while they are in the water. Attempts to "keep an eye on" valuables, or frequently return to check the valuables, and the inability of those who wear glasses to see well from the sea makes a substantial negative impact on the pleasure of beach goers. Heretofore there has been no solution other than to bury the valuables in the sand which is a poor solution at best.

SUMMARY OF THE INVENTION

The present invention completely resolves the above-stated difficulties by providing a lock box which can be secured deeply into the sand of the beach and is virtually impossible to remove by other than the person who has the key or combination, which can easily be kept in a bathing suit pocket or clipped on with a safety pin. In effect the user is able to provide himself with a one-locker locker room right at the beach.

The invention consists of a lock box capable of holding all the user's valuables and having a hole in the bottom which is inserted over the top end of a shaft having a screw bottom which is screwed deeply into the sand by a crank. After the shaft is deeply anchored into the beach, the crank handle is removed and actually put into the box, or through the box and used as a hasp to hold the lid of the box to the box body by virtue of a padlock engaged through an apperature in the crank handle. A loose sleeve over most of the extent of the shaft makes it completely impossible for anyone to even gain access to the shaft for rotation, inasmuch as rotation of the sleeve with a pipe wrench or the equivalent will not remote the shaft, and the box itself swivels on the shaft and is retained by a keeper enclosed within the lock box.

BRIEF DESCRIPTION OF THE DRAWINGS

FIG. 8 is a perspective view of a modification of the beach locker;

FIG. 9 is a section view of the locker in place in the sand;

FIG. 10 is a combination elevation and section view taken crosswise to FIG. 9;

FIG. 11 is a section view taken along Line 11—11 of FIG. 9:

DETAILED DESCRIPTION OF THE PREFERRED EMBODIMENT

Figures 1, 2, 3, 4, 5, 6, 7:
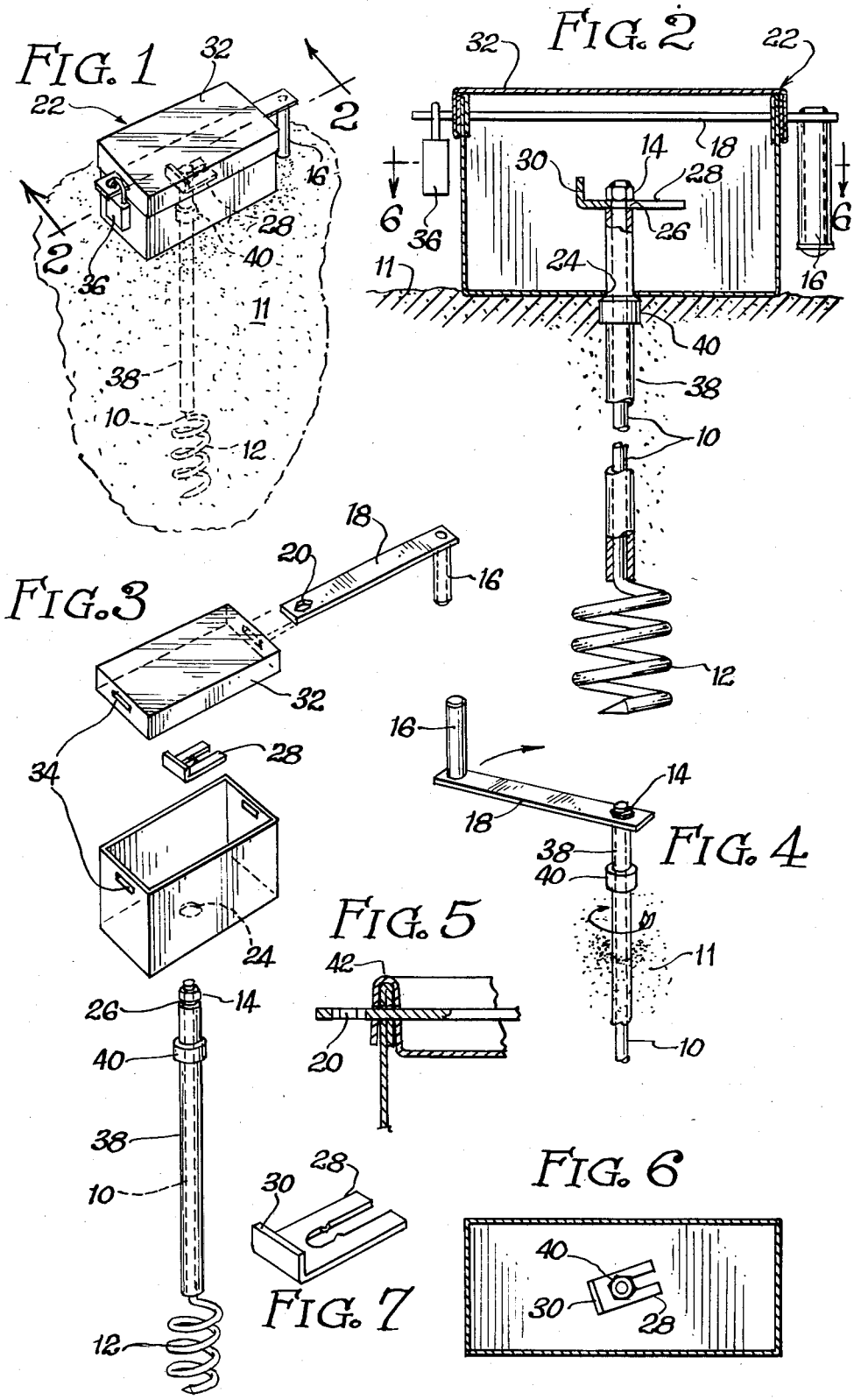
FIG. 1 is a perspective view of the device showing the shaft secured into the ground.
FIG. 2 is a side elevation view of the configuration shown in FIG. 1.
FIG. 3 is an exploded perspective view showing the different parts of the device.
FIG. 4 illustrates operation of the crank on the top of the shaft.
FIG. 5 is a detail showing penetration of the crank through the lock box container and body.
FIG. 6 is a top elevation view of the device in use but with the lid and crank handle removed.
FIG. 7 is a perspective view of the keeper.

In the preferred embodiment of the invention set forth in the drawings, the basic element for anchoring the unit is an elongated shaft 10 which has a lower portion which penetrates deep into the sand 11 of the sandy beach and terminates in a helical screw 12. The upper end of the shaft is made non-round at its upper tip by means of a hex nut 14 for engagement of a crank handle 16 having a shank 18. A hexagonal orifice 20 in the tip of the crank engages the hex nut 14 as shown in FIG. 4 and in conventional crank manner drives the screw 12. The entire device is about three feet tall, and it has been demonstrated that in approximately the proportions shown the shaft can be sunk all the way into the sand by means of the crank 16, and when thus sunk several strong men are unable to pull the shaft free of the sand without the use of the crank.

After the shaft has been embedded deeply into the sand by virtue of the screw and crank as detailed above a lock box 22 having a central hole in the bottom at 24 is inserted over the upper end of the shaft subsequent to removal of the crank, and by virtue of a groove 26 which is defined between the hex nut 14 and the remainder of the straight shaft a keeper 28 can be slipped over the tip of the shaft as shown in FIGS. 1, 2 and 6. The keeper has an upstruck flange 30 which is provided solely for the purpose of making it easy to grip with the thumb and forefinger.

Once the lock box is captured on the end of the shaft by the keeper 28, watches, wallets, jewelry, money, and anything else of any value can be put inside the box, subsequent to which the lid 32 is put into place as shown in FIG. 2. The lid is then locked onto the box by virtue of the shank 18 of the crank which passes through holes 34 in the box. A padlock 36 is then locked into orifice 20 with the obvious result of securely locking the lid onto the box body.

In addition to the structure described above, a sleeve 38 with a collar 40 at the top is engaged on the shaft loosely so that any attempt to unscrew the shaft would be defeated by the free rotation of the sleeve. Although as shown in FIG. 2 the shaft extends upwardly approximately half way into the box, the keeper positon could be equally well defined just over the collar so that no uplifting of the box at all would be possible.

One slight modification of the device is shown in FIG. 5 wherein the variant style lid 42 with a dish-shaped top portion is used so that the shank 18 serves as a carrying handle.

Another modification of the device is shown in FIGS. 8 through 11. In this embodiment the box body 44 is made in an injection mold and has a vertical rib 46 through which passes the shaft 10, to be kept as in the other embodiments with hex nut 14. The vertical rib has a central bore 48 which is enlarged to define a shoulder at 50 to receive to a limited depth of insertion the sleeve 52, which is different from the sleeve 38 in that it has no collar 40 and in this embodiment could be made of a tough plastic.

A modified form of the crank is shown at 54 which is similar to a lug nut wrench and has a crossbar 56 with an eyelet 58 at one end for the padlock and a detent bead 60 at the other end to retain the socket bearing member 62. The socket slides on the crossbar so that the operator can slide the socket centrally thereon and use both hands to twist the screw in the event added force is required.

Overall the unit provides extremely safe and secure lockertype valuable security system which renders the user's valuables completely immune to the casual, amateurish thefts that are perpetrated on the beach and even more importantly relieves the mind of the bather from worry over his valuables so that he or she can fully enjoy the leisure period free of worry over the one percent chance that unattended valuables might be stolen.

Certain variations of the above-described anchoring and locking mechanism are within the purview of the appended claims and the instant disclosure and description, including the possiblity that an expanded or exploded mechanism extend from the lower end of the shaft 10 which is operated by axially or rotational motion of an actuator of some type connected to the top of the shaft. Such mechanism might include radially extending blades which penetrate laterally into the sand from the very bottom of the shaft, or any other mechanism which extends from the shaft to firmly purchase the sandy beach soil and prevent the lifting free of the box and shaft from the beach.

Other modifications could include hinging the lid directly onto the box body and hinging the crank directly onto the shaft so that it swings open for rotational deployment and folds within the box for storage. The shaft could be made foldable, or telescoping, or in separate pieces for compactness. The box could itself be the activator or rotating member, connected to the shaft through a unidirectional rotational ratchet mechanism that is directionally reversible upon opening the box so that once the ratchet is set and the box locked it can be rotated to twist the screw in place and reverse-rotation causes the box to free-wheel. Other such modifications are clearly within the scope of the appended claims.

I claim:

1. A security device for anchoring an object to the earth comprising:

(a) a shaft having an upper portion attachable to said object and a lower portion;

(b) said lower portion being adapted to penetrate into the earth with anchor means to alternatively engage or disengage the earth;

(c) the upper portion of said shaft having actuator means for alternatively causing said anchor means to engage or disengage the earth;

(d) locking means operatively connected to said actuator means to disenable same when said locking means is locking, whereby a user can temporarily secure an object to the earth for safekeeping;

(e) said anchor means comprising a screw extending from the lower portion of said shaft and said actuator means comprises a crank to rotate said shaft and engage said screw;

(f) said locking means comprising a lock box capturing the upper portion of said shaft to prevent the cranking thereof and thus the operation of said screw;

(g) said crank being removable from said shaft and said lock box being engaged on said shaft through a hole in the bottom thereof and retained by a keeper engaged on the upper portion of said shaft; and (h) said lock box having a lid and body portion, both of which have aligned holes, and said crank including a straight shank with an apertured tip which can be passed through said holes and padlocked through said aperture to secure said lock box on said shaft.

2. Structure according to claim 1 wherein said lid has a dished central portion and said shank passes across said dished portion to define a carrying handle.

* * * * *